US005520524A

United States Patent [19]

Takemoto et al.

[11] Patent Number: 5,520,524

[45] Date of Patent: May 28, 1996

[54] SCROLL-TYPE COMPRESSOR WITH REDUCED START-UP ORBITING RADIUS

[75] Inventors: Tsuyoshi Takemoto, Kouta-cho; Hirotaka Egami, Kariya; Tetsuhiko Fukanuma, Kariya; Yasushi Watanabe, Kariya, all of Japan

[73] Assignees: Nippondenso Co., Ltd.; Kabushiki Kaisha Toyoda Jidoshokki Seisakusho, both of Kariya, Japan

[21] Appl. No.: 322,920

[22] Filed: Oct. 13, 1994

[30] Foreign Application Priority Data

Oct. 13, 1993 [JP] Japan ..... 5-256130

[51] Int. Cl.[6] ..... F04C 18/04

[52] U.S. Cl. ..... 418/14; 418/55.5; 418/57

[58] Field of Search ..... 418/14, 55.5, 57

[56] References Cited

U.S. PATENT DOCUMENTS

| | | | |
|---|---|---|---|
| 3,924,977 | 12/1975 | McCullough | 418/14 |
| 4,383,805 | 5/1983 | Teegarden et al. | 418/14 |
| 4,457,675 | 7/1984 | Inagaki et al. | 418/14 |
| 4,580,956 | 4/1986 | Takahashi et al. | 418/14 |
| 5,290,161 | 3/1994 | Swain | 418/14 |
| 5,328,342 | 7/1994 | Ishii et al. | 418/55.5 |

FOREIGN PATENT DOCUMENTS

| | | | |
|---|---|---|---|
| 351143 | 5/1928 | Belgium . | |
| 0457603 | 11/1991 | European Pat. Off. . | |
| 3911882 | 10/1989 | Germany . | |
| 4339203 | 5/1994 | Germany . | |
| 55-60684 | 5/1980 | Japan | 418/14 |
| 62-282186 | 12/1987 | Japan . | |
| 2-176179 | 7/1990 | Japan . | |
| 357893 | 3/1991 | Japan . | |
| 3233178 | 10/1991 | Japan | 418/55.5 |
| 665260 | 4/1988 | Switzerland . | |
| 2025530 | 1/1980 | United Kingdom . | |
| 2191246 | 12/1987 | United Kingdom . | |

*Primary Examiner*—John J. Vrablik
*Attorney, Agent, or Firm*—Cushman, Darby & Cushman

[57] ABSTRACT

A scroll compressor having a driving shaft 6, on which a bushing 10 and a balancing weight 9 are supported. The drive shaft 6 includes, at its end, a drive projection **6*a*, which is engaged with a driven groove 10*a* formed in the bushing 10. A spring 20 is arranged between the drive projection 6*a* and the bushing 10 for urging the latter radially inwardly to reduce the radius of the orbital movement of the bushing 10. A centrifugal force generated in the bushing when the drive shaft 6 is rotated causes the bushing 10 to be moved radially outwardly to increasing the radius of the orbital movement of the bushing 10**.

8 Claims, 8 Drawing Sheets

Fig.5-A
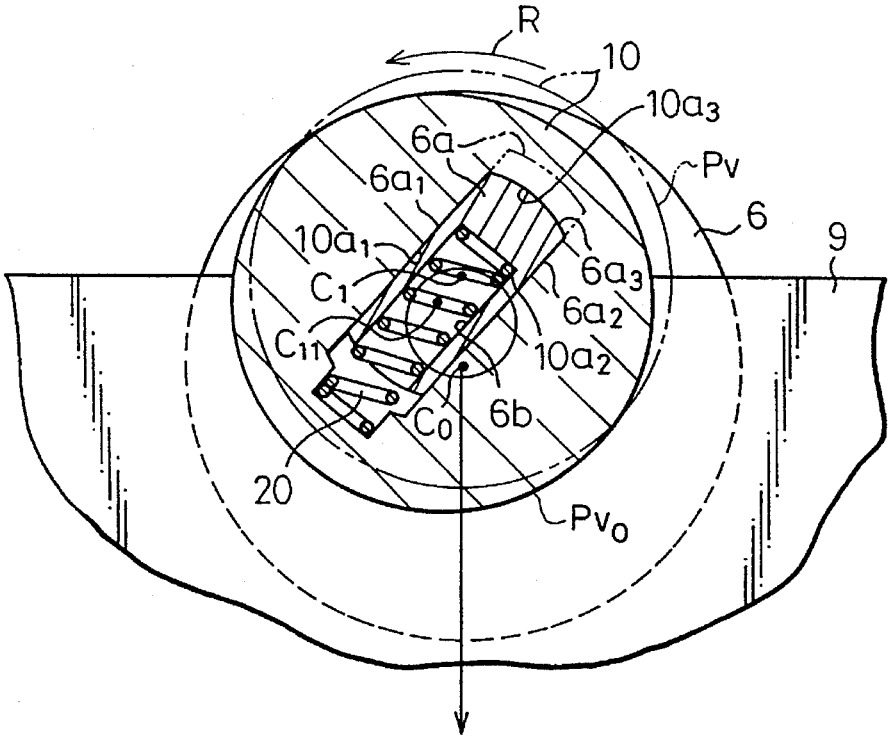
Fig.5-B
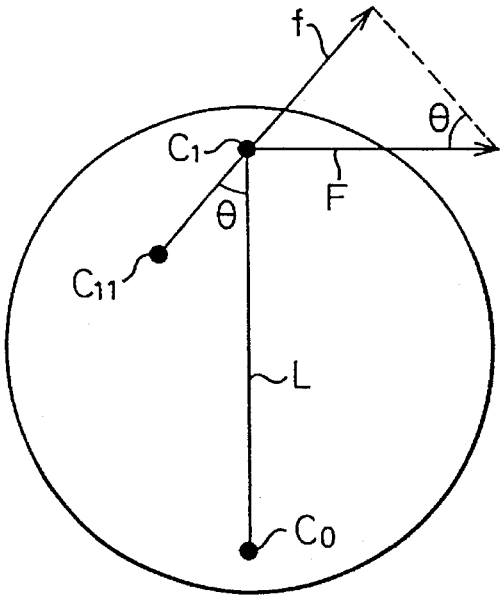

SCROLL-TYPE COMPRESSOR WITH REDUCED START-UP ORBITING RADIUS

BACKGROUND OF THE INVENTION

1. Field of the Invention

The present invention relates to a scroll-type capable of, for example, being used in a refrigerating circuit in an air conditioning system for an automobile.

2. Description of Related Art

Known in the prior art is a scroll-type compressor which includes a fixed scroll member, a movable scroll member which is arranged to face the fixed scroll member, a rotating shaft and a bushing member which is located on an end of the shaft in such a manner that, with respect to the shaft, the bushing is eccentric, on which bushing the movable scroll member is relatively rotatably supported. A rotating movement of the drive shaft causes the movable scroll member to effect an orbital movement, while the movable scroll member is prevented from being rotated about its own axis, so that, between a scroll wall of the fixed scroll member and a scroll wall of the movable scroll member, closed chambers are formed, the volume of which varies in accordance with the orbital movement of the movable scroll member. During the orbital movement of the movable scroll member, the closed chambers are moved radially inwardly toward the inner ends of the fixed and movable scroll members, so that a refrigerant gas in the closed chambers is discharged from an outlet port formed in a scroll base plate of the fixed scroll member.

During the compression operation, the scroll walls of the fixed and movable scroll members are brought into contact with each other at a plurality of spaced locations. Thus, any inaccuracy in the shape of the fixed and movable scroll members at these location from the desired shape causes the medium to leak, thereby reducing the compression efficiency. Thus, some means is necessary to compensate the above mentioned inaccuracy in the shape of the scroll members, thereby maintaining the desired contacted condition between the scroll portions of the fixed and movable scroll members.

Thus, in the Japanese Unexamined Patent Publication (Kokai) No. 2-176179, a construction is proposed wherein the scroll compressor has a drive shaft having, at its one end, drive projections defining driving force transmission surfaces, and a bushing having grooves defining driving force receiving surfaces. These drive projections and grooves are engaged with each other in such a manner that the driving force transmission surfaces and driving force receiving surfaces are slidably movable with each other. Furthermore, the planes on the driving projections are, with respect to a line passing through the axis of the bushing and of the rotating shaft, inclined rearwardly in the direction of the rotation of the rotating shaft.

Thus, when the bushing receives a compression reaction force from the movable scroll member, the bushing moves along the planes on the driving projections, so that the radius of the orbital movement of the movable scroll during the operating (rotating) condition of the compressor becomes larger than that during the non-operating (stopping) condition of the compressor. In other words, during the orbital movement of the movable scroll member, a compression reaction force acts on the bushing in order to obtain an increased radius of the orbital movement, thereby maintaining the scroll wall members in contact with each other, irrespective of an existence of small inaccuracies in the scroll profiles of the members.

In the operation of the compressor of the above mentioned Japanese Unexamined Patent Publication No. 2-176179, a small radius of the orbital movement of the movable scroll member is obtained until the compression reaction force is increased after the commencement of the operation of the compressor. The small value of the radius of the orbital movement of the movable scroll member allows a space to be created between the scroll walls of the fixed and movable scroll members irrespective of a fact that the compressor is operated. Such a generation of the space can, which is continued for a suitable period, reduce the rapidity of the increase in the load when the compressor is brought into the operation, thereby reducing vibration as well as shock otherwise generated when the compressor is switched on.

In a scroll type compressor, a balance weight is usually provided for canceling the centrifugal force generated by the movable scroll member which is subjected to an orbital movement. However, it is difficult to provide a balance weight of a desired value which is effective to fully balance the centrifugal force due to the fact that an available space is limited. As a result, a residual centrifugal force, which is out of the balancing range of the balancing weight, causes the radius of the orbital movement to be rapidly increased after the compressor is switched on, and an effective suppression of a rapid increase in the load upon the switching on the compressor cannot be obtained.

Furthermore, the prior art compressor suffers, also, from a problem in that the compressor tries to compress the liquid refrigerant when the compressor is brought into an operation after a prolonged period of the stoppage due to the fact the refrigerant is liquidized during such a prolonged stoppage. The above mentioned residual centrifugal force causes the radius of the orbital movement to be rapidly increased after the switching on of the compressor, causing the clearance between the scroll walls to be rapidly reduced. As a result, a compression of a liquid state refrigerant is rapidly generated, thereby producing an abnormally increased pressure, thereby producing noise, damage to the scroll walls and a delivery valve, as well as slippage at the frictional surfaces of an electromagnetic clutch.

SUMMARY OF THE INVENTION

An object of the present invention is to provide a scroll type compressor capable of preventing a rapid increase in the load when the pump is brought into operation.

According to the present invention, a scroll compressor is provided, comprising:

a housing;

a drive shaft rotatably supported in the housing;

a first scroll member arranged in the housing and fixed to the housing;

a second scroll member movably arranged in the housing;

the first and second scroll members having scroll portions which are arranged in a side-by-side relationship in a radial direction so that radially spaced chambers are created;

a bushing arranged eccentric to the drive shaft to receive the rotating movement therefrom;

connecting means between the drive shaft and the bushing for allowing transmission of the rotating movement of the drive shaft to the bushing so as to obtain an orbital movement of the bushing about an axis of the drive shaft;

means for preventing the scroll member on the bushing from rotating about its own axis, while allowing an orbital movement of the movable scroll member about an axis of the drive shaft, so that said radially spaced chambers move radially inwardly while the volumes of the chambers decrease;

inlet means for introducing the medium to be compressed into the chambers when the volume thereof is large, and;

outlet means for discharging the compressed medium from the chambers when the volume thereof is small;

means, responsive to a centrifugal force, for allowing a relative radial movement of the bushing between a first position of a smaller value of a radius of the orbital movement of the bushing and a second position of a larger value of the radius of the orbital movement, and;

biasing means for obtaining a movement of the bushing so that it normally assumes the first position of smaller value of the radius of the orbital movement, a centrifugal force on the bushing causing it to be moved toward the second position against the force of the biasing means. Advantageously, according to the present invention, a scroll compressor comprises:

a housing;

a drive shaft rotatably supported in the housing;

a first scroll member arranged in the housing and fixed to the housing;

a second scroll member movably arranged in the housing;

the first and second scroll members having scroll portions which are arranged in a side-by-side relationship in a radial direction so that radially spaced chambers are created;

a bushing arranged eccentric to the drive shaft to receive the rotating movement therefrom;

the drive shaft having a projection which extends integrally, axially from an end of the drive shaft at a location spaced from the central axis, said bushing having a groove into which the drive projection is received, means for preventing the scroll member on the bushing from being rotated about its own axis, while allowing an orbital movement of the movable scroll member about an axis of the drive shaft, so that said radially spaced chambers move radially inwardly while the volumes of the chambers decrease;

inlet means for introducing a medium to be compressed into the chambers when the volume thereof is large, and;

outlet means for discharging the compressed medium from the chambers when the volume thereof is small;

said drive projection defining a drive plane extending in parallel along the axis of the drive shaft while extending substantially radially, said groove defining a drive force receiving plane extending in parallel along the axis of the drive shaft while extending substantially radially and which is slidably guided along the drive plane, the drive plane and the drive force receiving plane being, in a cross section, transverse to the axis of the drive shaft, inclined with respect to line connecting the center of the bushing and the center of the bushing in a direction rearwardly of the direction of the rotation of the drive shaft, and;

biasing means, arranged between the projection and the bushing in the groove, for obtaining a movement of the bushing so that it assumes a first position of a smaller value of the radius of the orbital movement, a centrifugal force on the bushing causing it to move toward the second position against the force of the biasing means.

Also, advantageously, according to the present invention, a scroll compressor comprises:

a housing;

a drive shaft rotatably supported in the housing;

a first scroll member arranged in the housing and fixed to the housing;

a second scroll member movably arranged in the housing;

the first and second scroll members having scroll portions which are arranged in a side-by-side relationship in a radial direction so that radially spaced chambers are created;

a bushing arranged eccentric to the drive shaft to receive the rotating movement therefrom;

the drive shaft forming, at its end, a drive groove which extends axially the bushing having a projection which extends integrally, axially from bushing at a location spaced from the central axis and which is inserted into the groove of the drive shaft;

means for preventing the scroll member on the bushing from rotating about its own axis, while allowing an orbital movement of the movable scroll member about an axis of the drive shaft, so that said radially spaced chambers move radially inwardly while the volumes of the chambers decrease;

inlet means for introducing a medium to be compressed into the chambers when the volume thereof is large, and;

outlet means for discharging the compressed medium from the chambers when the volume thereof is small;

said drive groove defining a drive plane extending in parallel along the axis of the drive shaft while extending substantially radially, said drive force receiving projection defining a drive force receiving plane extending in parallel along the axis of the drive shaft while extending substantially radially and which is slidably guided along the drive plane, the drive plane and the drive force receiving plane being, in cross section transverse to the axis of the drive shaft, inclined with respect to a line connecting the center of the bushing and the center of the drive shaft in a direction against the direction of the rotation of the drive shaft, and;

biasing means, arranged between the shaft in the groove and the projection, for obtaining a movement of the bushing so that it normally assumes a first position of a smaller value of the radius of the orbital movement, the centrifugal force of the bushing causing it to move towards the second position against the force of the biasing means.

According to the present invention, the operation of the compressor commences when the value of the radius of the orbital movement is small, i.e., no contact occurs between the fixed and movable scroll members. As a result, a certain delay time occurs before a normal condition, when the value of the radius of the orbital movement is large and contact occurs between a fixed and movable scroll members, is obtained. Due to such a delay, a rapid increase in load which may otherwise occur, can be prevented.

BRIEF DESCRIPTION OF ATTACHED DRAWINGS

Figure 3:
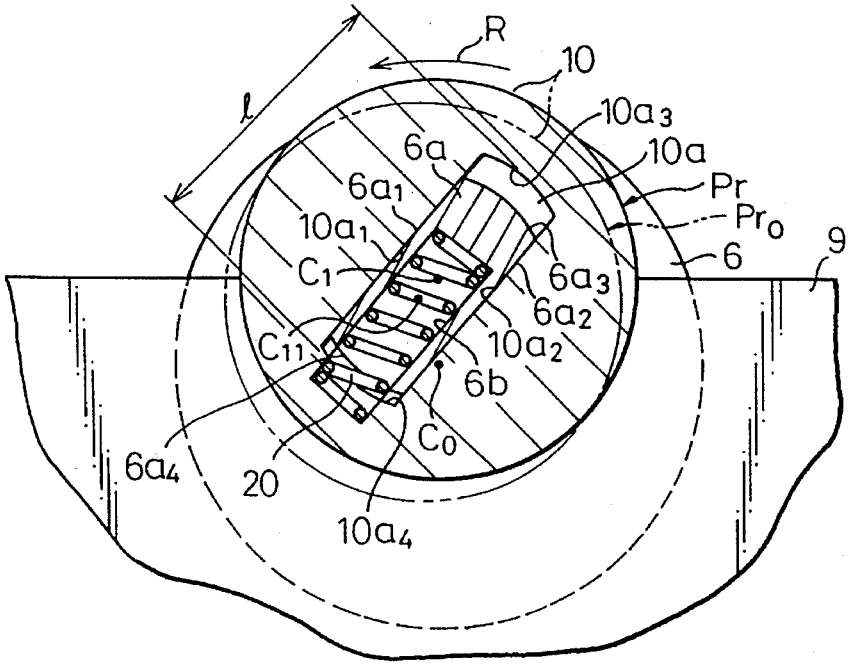
FIG. 3 is a cross sectional view taken along line III—III in FIG. 1, when the compressor is operating.

FIG. 5-A is similar as FIG. 3 but the compressor is at rest.

FIG. 5-B is an enlarged view of a portion of FIG. 5-A, illustrating a function for increasing the radius an orbital movement after the commencement of the operation of the compressor.

Figure 4:
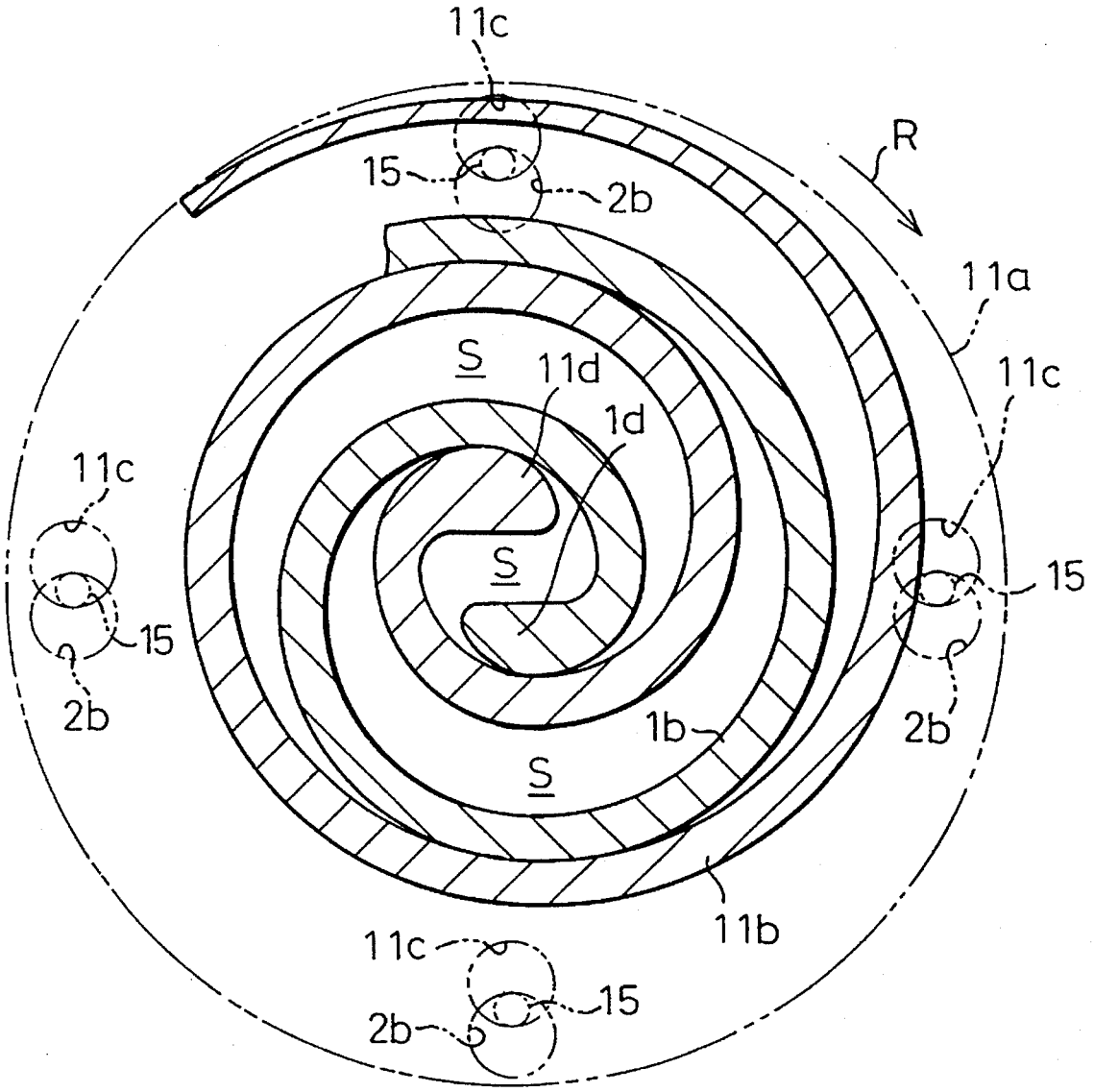
FIG. 4 is a cross sectional view taken along line IV—IV in FIG. 1.
Figure 6:
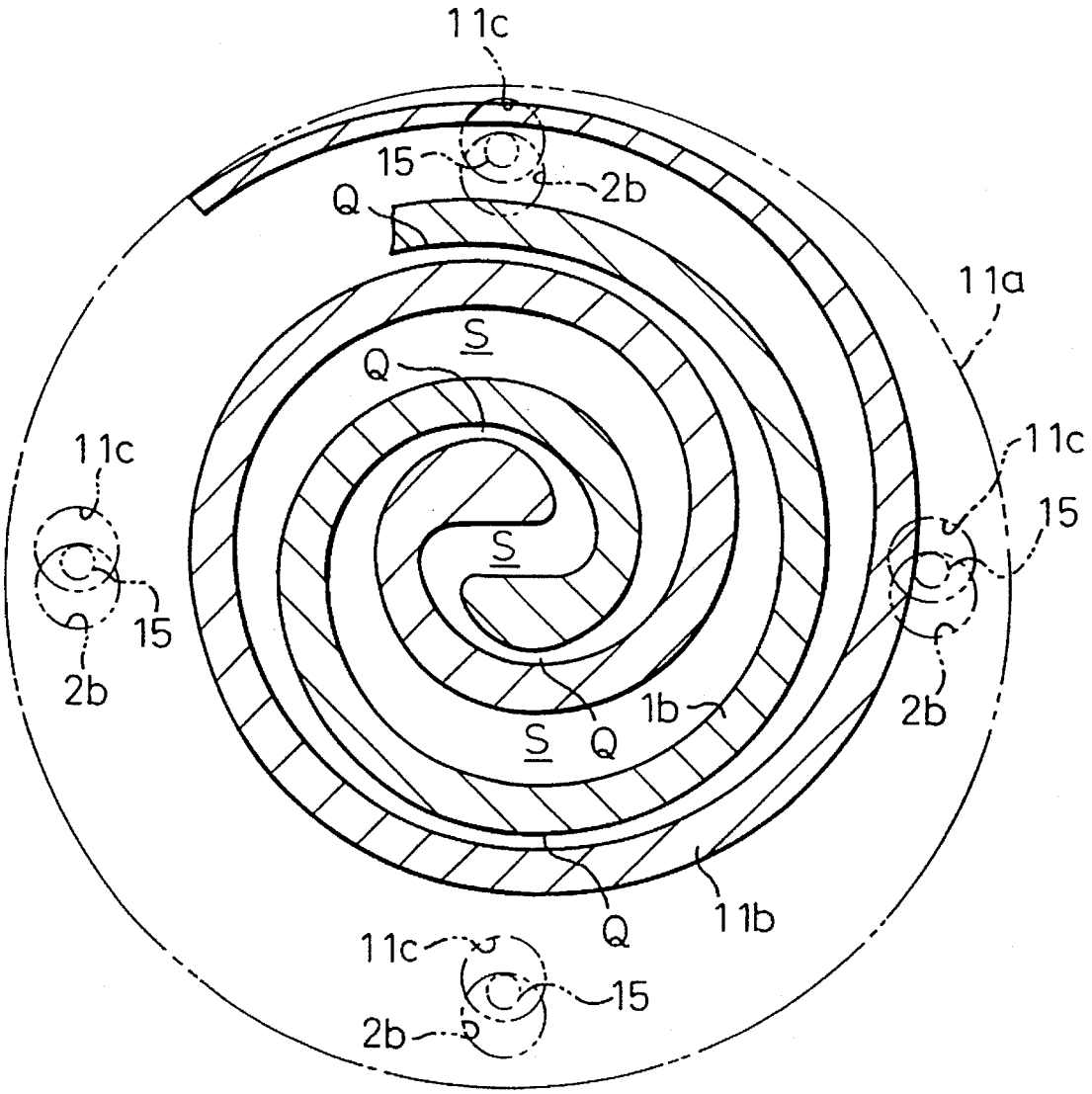

FIG. 6 is similar to FIG. 4 but illustrating the compressor is at rest.

Figure 7:
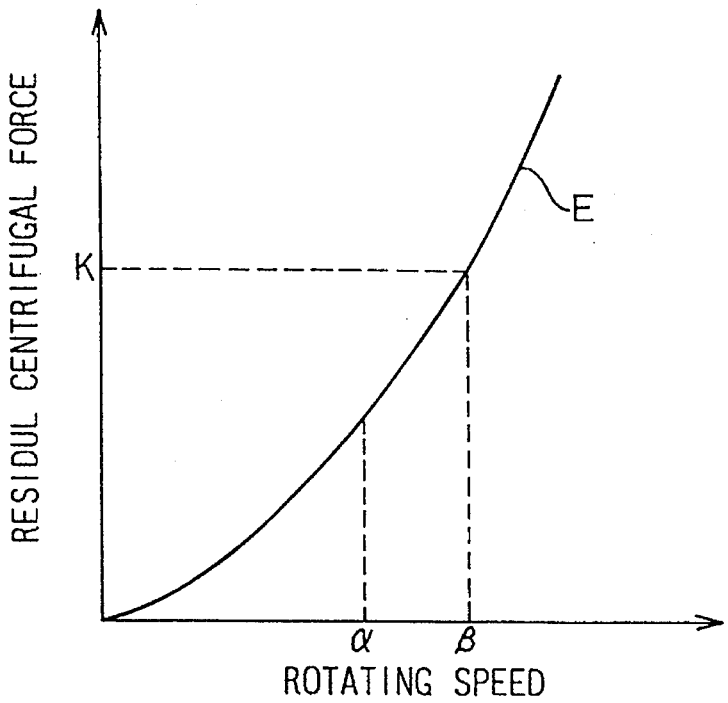

FIG. 7 is a graph illustrating a relationship between a rotating speed and a residual centrifugal force.

Figure 8:
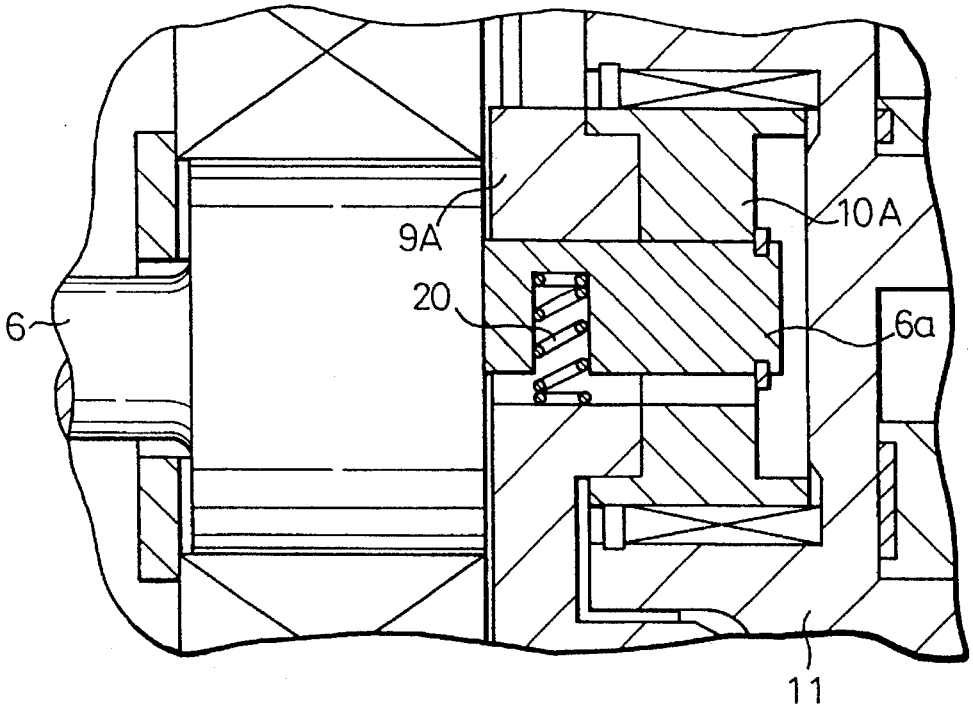

FIG. 8 is a partial view of a compressor of a second embodiment.

Figure 9:
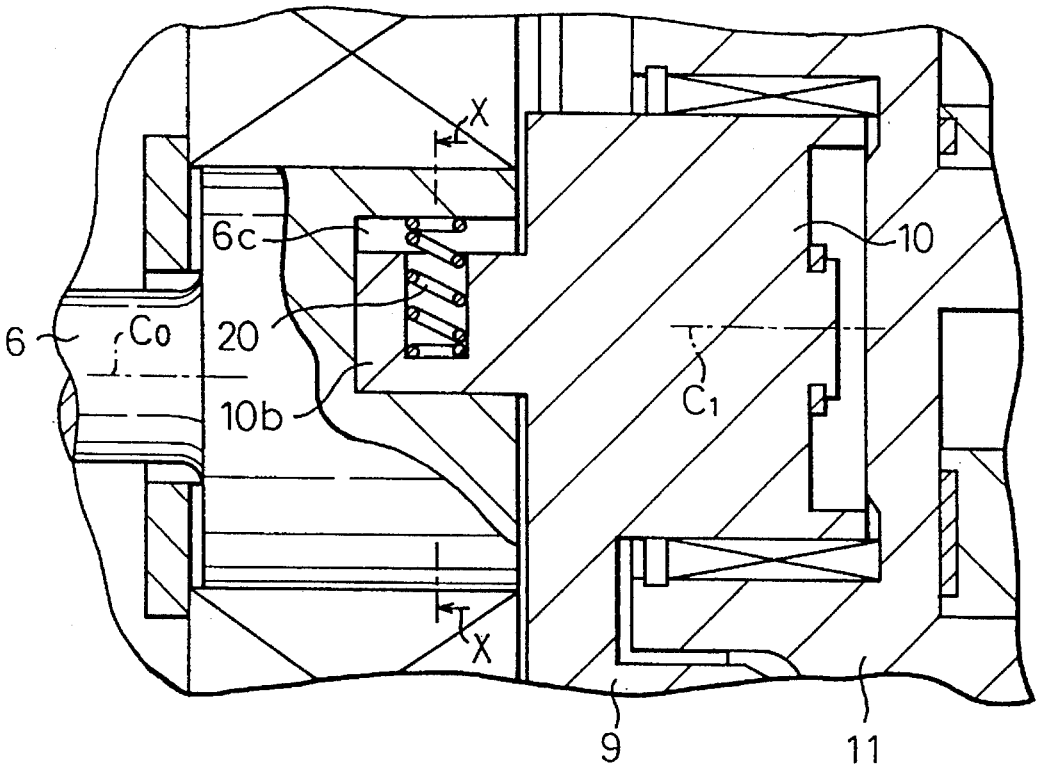

FIG. 9 is a partial view of a compressor in a third embodiment.

Figure 10:
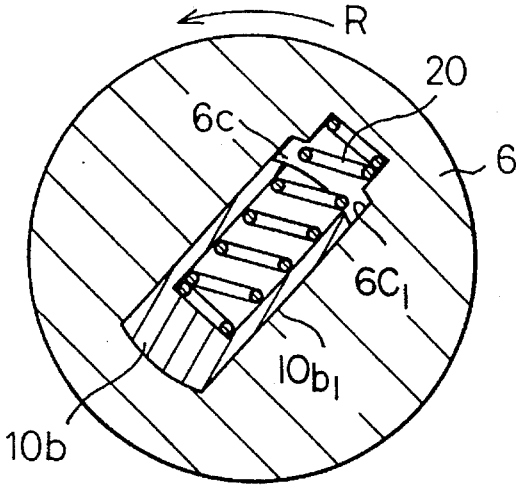

FIG. 10 is a cross sectional view taken along line X—X in FIG. 9.

Figure 11:
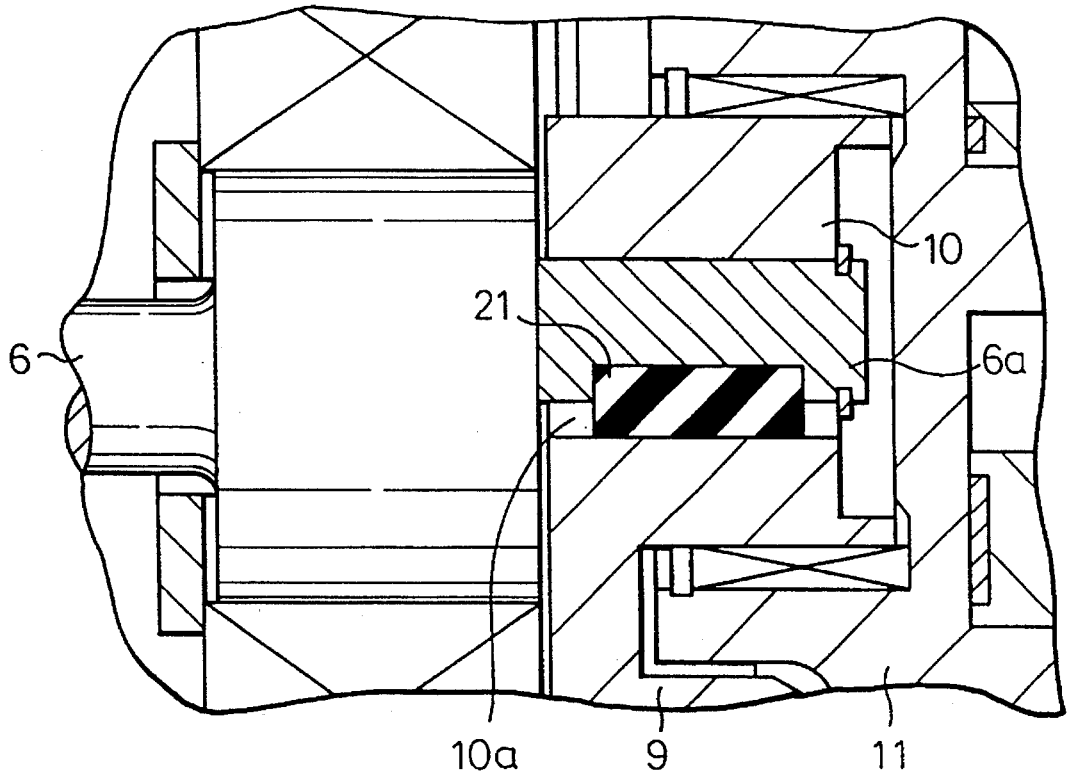

FIG. 11 is a partial view of a compressor in a fourth embodiment.

DESCRIPTION OF PREFERRED EMBODIMENTS

Figure 1:
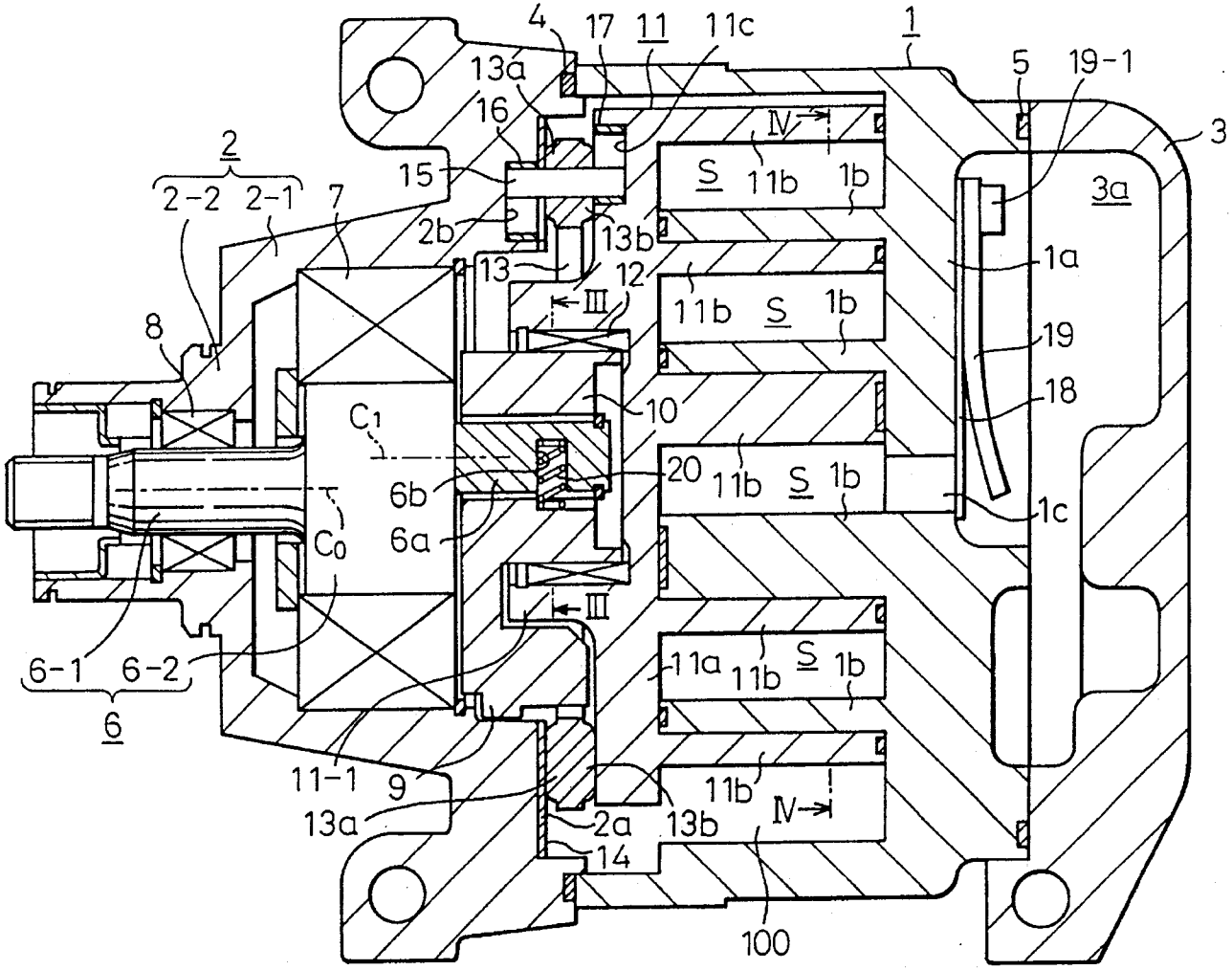
FIG. 1 is a longitudinal cross sectional view of a scroll compressor according to the present invention.

Now, a first embodiment of the present invention will be explained with reference to FIGS. 1 to 7. In FIG. 1, a reference numeral 1 denotes a center housing made of an aluminum alloy material, which also functions as a fixed scroll member. A front housing 2 and rear housing 3, which are also made from an aluminum alloy material, are fixedly connected to the central housing 1 by means of suitable means, such as bolts and nuts (not shown). The central housing 1 and the front housing 2 have faced end surfaces, one of which forms an annular groove into which a seal ring 4 is stored, so that the housings 1 and 2 are sealed together at the faced surfaces. Similarly, the central housing 1 and the rear housing 3 have faced end surfaces, one of which forms an annular groove into which a seal ring 5 is stored, so that the housings 1 and 3 are sealed with each other at the faced surfaces. As a result, an outlet chamber 3*a* for the refrigerant gas to be discharged is created between the central and rear housings 1 and 3. An inlet chamber 100 for the gas to be compressed is created between the central and front housings 1 and 2. Arranged in the outlet chamber 3*a* is a reed valve used as delivery valve 18. The delivery valve 18 has an end connected to the housing, together with a stopper 19, by means of a bolt 19-1. The delivery valve 18 is arranged to normally close an exhaust port 1*c* formed in the base plate portion 1*a* of the central housing 1.

As shown in FIG. 1, a reference numeral 6 denotes a drive shaft, which has a shaft portion 6-1 and an increased diameter portion 6-2. The front housing 2 is formed with a cup shaped portion 2-1, to which the increased diameter portion 6-2 of the rotating shaft 6 is rotatably supported via a bearing unit 7, which is housed inside the cup shaped portion 2-1. The front housing 2 is also provided with a boss portion 2-2 which extends outwardly from the cup shaped portion 2-1. The shaft portion 6-1 extends through the boss portion 2-2. A shaft seal member 8 is arranged between the shaft portion 6-1 of the drive shaft 2 and the boss portion 2-2 of the front housing 2. The shaft portion 6-1 projects out of the boss portion 2-2, so that it is connected to a clutch device (not shown) for controlling the mechanical connection of a rotating movement from a rotating source, such as a crankshaft of an internal combustion engine, to the compressor shaft 6.

Figure 2:
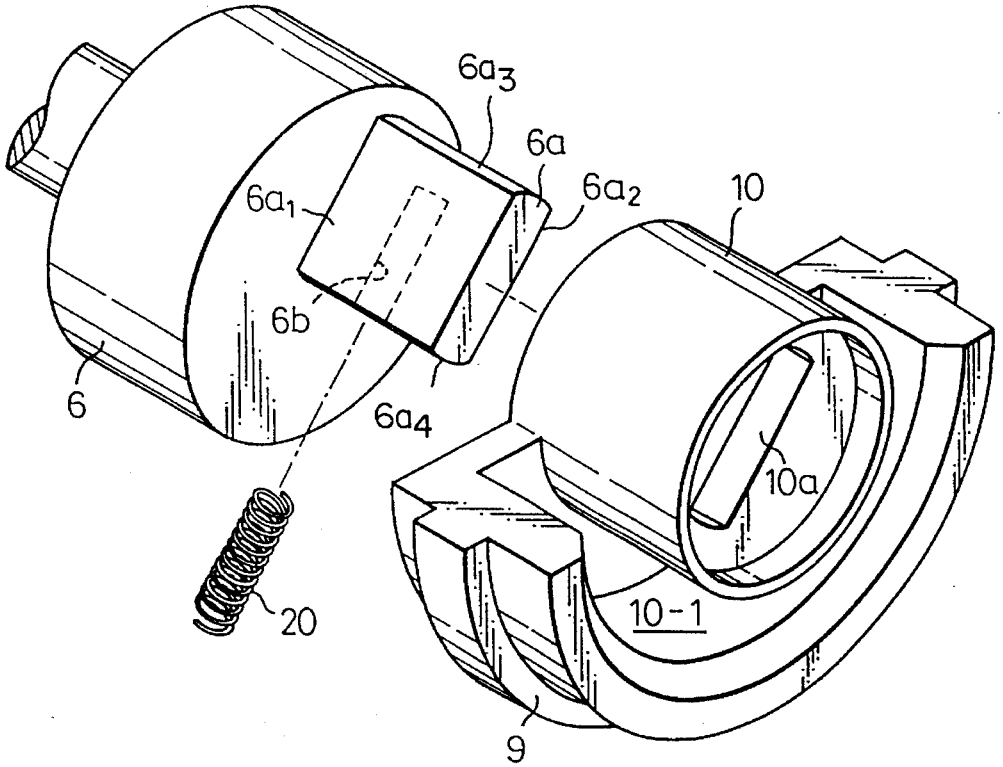
FIG. 2 is a partial, dismantled, perspective view of the compressor in FIG. 1.

The rotating shaft 6 has, at the end remote from the shaft portion 6-1, a drive projection 6*a* which is eccentric with respect to the axis of the shaft 6. As shown in FIG. 2, the projection 6*a* is defined by a circumferentially spaced power transmission plane $6a_1$ and an inclination limiting plane $6a_2$, which extend parallel to the axis of the shaft 6, and radially spaced curved planes $6a_3$ and $6a_4$ which connect the planes $6a_1$ and $6a_2$ with each other.

A reference numeral 10 denotes a bushing of a basically cylindrical shape which is supported by the drive projection 6*a* of the drive shaft 6. A balancing weight 9 is formed integrally with respect to the bushing 10. A movable scroll member 11 is rotatably supported on the bushing 10 via a bearing unit 12, as shown in FIG. 1. As shown in FIG. 2, the bushing 10 defines a circumferential groove 10-1 radially inwardly of the weight member 9 for allowing the bearing assembly 12 to be inserted, while, as shown in FIG. 1, the movable scroll member 11 has a central annular boss portion 11-1, which is also for allowing the bearing assembly to be stored.

As shown in FIGS. 3 and 5, the bushing 10 has a center $C_1$ or $C_{11}$, which is radially spaced from the center $C_0$ of the rotating shaft 6, which causes the movable scroll member 11 on the bushing 10 to execute an orbital movement about the axis of the drive shaft 6 when a rotating movement is applied to the drive shaft 6.

The fixed scroll member 1 has a scroll portion 1*b*, while the movable scroll member 11 has a scroll portion 11*b*. The arrangement of the fixed and movable scroll members is such that the scroll portion 1*b* of the fixed scroll member 1 is axially contacted with a base plate 11*a* of the movable scroll member 11, on one hand, and the scroll portion 11*b* of the movable scroll member 11 is axially contacted with a base plate 1*a* of the fixed scroll member 1, on the other hand, and in such a manner that the scroll portion 1*b* of the fixed scroll member 1 and the scroll portion 11*b* of the movable scroll member 11 are radially contacted with each other at spaced locations as shown in FIG. 4. As a result of this arrangement radially spaced apart closed chambers S are created between the scroll base plates 1*a* and 11*a* and the scroll wall portions 1*b* and 11*b*. Furthermore, the orbital movement of the movable scroll member 11 caused by the rotation of the drive shaft 6 causes the closed chambers S to be radially inwardly moved. During the radial movement of the closed chambers S, compression of the fluid takes place. Namely, an intake chamber 100 connected to a source of the refrigerant is opened to a chamber S when it is located on the outermost position, which causes the fluid to be introduced into the chamber S. The radially inward displacement of the closed chamber S causes the fluid to be compressed. An exhaust port 1*c* connected to a receiver (not shown) such as a condenser in a refrigerating cycle is finally opened to the closed chamber when it is located on the innermost position, which causes the fluid to be discharged, via the port 1*c* and the outlet chamber 3*a*, to the receiver.

The balancing weight 9 is constructed such that a centrifugal force generated by the balancing weight 9 is somewhat smaller than a centrifugal force generated by the movable scroll member 11, so that the balancing weight 9 can partly cancel the centrifugal force of the movable scroll member 11 which is generated by the orbital movement of the movable scroll member latter member 11.

As shown in FIG. 2, the bushing 10 forms an axially extending groove 10*a*, to which the projected portion 6*a* of the drive shaft 6 is fitted. As shown in FIG. 3, the driving force receiving groove 10*a* defines a driving force receiving surface $10a_1$ and an inclination limiting surface $10a_2$, which are circumferentially spaced in parallel and extending parallel to the axis of the drive shaft 6, as well as radially spaced curved surfaces $10a_3$ and $10a_4$, which extend parallel to the axis of the drive shaft 6. The spacing between the driving force receiving surface $10a_1$ and the inclination limiting surface $10a_2$ of the groove 10*a* is slightly larger than the spacing between the driving force receiving surface $6a_1$ and the inclination limiting surface $6a_2$ of the driving projection 6*a*, which allows the projection 6*a* to be fitted to the groove 10*a*. Furthermore, as shown in FIG. 3, in the radial direction, the radial length of the groove 10*a* is sufficiently larger than the radial length of the drive projection 6*a*, which is enough to allow the drive projection 6*a* to move in the groove 10*a* along the drive force transmitting plane $6a_1$. In other words, the bushing 10 can be moved, with respect to the drive projection 6*a*, along the drive force transmitting plane $6a_1$.

The inclination constraint plane $6a_2$ of the drive projection 6 functions to prevent the bushing 10 from being uncontrollably inclined. However, instead of the inclination constraint plane $6a_2$, any desired shape such as an arc shape can be used so long as it is not one that can prevent the bushing from being moved.

As shown in FIG. 5-B, with respect to the line L passing the center $C_1$ of the bushing 10 and the center $C_0$ of the rotating shaft 6, the driving force transmitting plane $6a_1$ is inclined at an angle θ in the direction opposite to the direction of the rotation of the rotating shaft 6 as shown by an arrow R, which angle is, in the described embodiment, about 30 degrees.

A range of displacement of the bushing 10 is smaller than the radius r of the orbital movement of the bushing 10. Namely, in FIG. 3, the bushing 10 is constrained between a first extreme position (rest position) as shown by a dotted line $Pr_0$ and a second extreme position (normal position) Pr as shown by a solid line. The constraining position Pr as shown by the solid line is determined by a mutual contact between the scroll walls 1*b* and 11*b* as shown in FIG. 4, while the constraining position $Pr_0$ as shown by the dotted line is determined by a mutual contact between the limiting surface $6a_3$ of the driving projection 6*a* and the limiting surface $10a_3$ of the driving force receiving groove 10*a* as shown in FIG. 1. In other words, a radius r of the orbital movement of the scroll member 11 when the bushing 10 is in the constrained position Pr as shown by the solid line is larger than a radius $r_0$ of the orbital movement of the scroll member 11 when the bushing 10 is in the constrained position $Pr_0$ as shown by the phantom line.

As shown in FIGS. 3 and 5, the driving projection 6*a* is formed with a spring-holding blind bore 6*b* radially opened at an end opposite from the limiting plane $6a_3$. A coil spring 20 is held in the bore 6*b*, so that a spring force is generated in a radial direction for causing the faced planes $6a_3$ and $10a_3$ to be moved toward each other. In other words, the spring 20 urges the bushing 10 so that is moved to the limiting position $Pr_0$ for reducing the radius r of the orbital movement of the movable scroll member 11.

As shown in FIG. 1, the front housing 2 forms, at the end facing the housing 1, a pressure receiving wall 2*a*. Between the scroll base plate 11*a* of the movable scroll member 11 and the pressure receiving wall 2*a* of the front housing 2, a rotating ring 13 made of an aluminum alloy and an anti-friction plate 14 made of a steel are arranged. The rotating ring 13 is formed with a plurality of circumferentially spaced fixedly axially opposite pairs of pressure receiving projected portions 13*a* and 13*b*. Namely, in each of the pairs, the projected portion 13*a* is formed on one side of the ring 13 facing the plate 14, while the projected portion 13*b*, which is axially opposite the portion 13*a*, is formed on the other side of the ring 13 facing the rear side of the base plate 11*a* of the movable scroll member 11. A plating of nickel-boron is formed on the rear side of the base plate 11*a* of the movable scroll member 11 contacting the pressure receiving projected portions 13*b* of the rotating ring 13.

To the plurality of pairs (more than three pairs) of the opposite pressure receiving projected portions 13*a* and 13*b*, respective self rotation stopping pins 15 are rotatably inserted, in such a manner that the pins 15 axially extend out of the respective portions 13*a* and 13*b*. The pressure receiving wall 2*a* is formed with a plurality of equiangularly spaced circular recesses 2*b* for receiving the respective ends of the pins 15 projected out of the respective portions 13*a* of the ring 13. Similarly, the scroll base plate 11*a* is formed with a plurality of equiangularly spaced circular recesses 11*c* for receiving the ends of the pins 15 projected out of the respective portions 13*b* of the ring 13. Namely, equiangularly spaced opposite pairs of the recess 2*b* and 11*c* are proved at angular locations corresponding to that of the respective pins 15 as shown in FIG. 4. However, in each pairs, the recess 2*b* and 11*c* are spaced diametrically with respect to the corresponding pin 15. Finally, anti-abrasion sleeves 16 and 17 made of copper material are inserted into the recess 2*b* and 11*c*, respectively.

The rotation of the rotating shaft 6 causes the movable scroll member 11 to be subjected to an orbital movement about the axis $C_0$ of the shaft 6. As a result, the refrigerant gas introduced, from the inlet chamber 100, into a closed chamber S between the scroll members 1 and 11, when it is in its radially outward position. The orbital movement of the movable scroll member 11 causes the closed chamber S to be radially moved toward the inner ends 1*d* and 11*d* of the scroll members 1 and 11, respectively, while the volume of the chamber S is reduced. Finally, the closed chamber S is moved to the innermost position where the chamber S is opened to the outlet port 1*c* formed in the base plate 1*a* of the central housing 1. The pressure of the gas in the chamber S, which is compressed as the volume of the chamber is reduced, causes the delivery valve 18 to be displaced against the resilient force of the valve 18, so that the gas is discharged into the outlet chamber 3*a*. The degree of the opening of the delivery valve 18 is limited by the retainer 19. Namely, the retainer 19 prevents the delivery valve 18 from buckling. The compression of the refrigerant gas in the closed chamber S causes a reaction force to be generated in the scroll base plate 11*a* of the scroll member 11, which force is supported by the pressure receiving wall 2*a* of the front housing 2 via the pressure receiving portions 13*b* and 13*a* of the ring 13.

During the orbital movement of the movable scroll member 11, the self rotation prohibiting pins 15 execute an orbital movement about the axis of the shaft, while the pins 15 are held between faced portions of the inner peripheral surfaces of the sleeves 17 fitted to the corresponding circular recess 11*c* of the movable scroll member 11 and the sleeves 16 fitted to the corresponding circular recess 2*b* of the front housing 2. As a result, the rotating ring 13 is urged in such a manner that it is moved in a direction away from the center of the orbital movement. When the inner diameter of the sleeves 16 and 17 is D and the diameter of the self rotation prohibiting pin 15 is d, the radius of the orbital movement of the bushing 10 is equal to D–d. Therefore, between the inner diameter D of the bushing 10, the diameter d of the pin 15 and the radius r of the orbital movement of the bushing 10, i.e., the radius of the orbital movement of the movable scroll member 11, a relationship, that is D=d+r, is obtained. This relationship limits the radius of the orbital movement of the movable scroll member 11 to r. In other words, the rotary ring 13 attains an orbital movement at a radius which is equal to one half of the radius r of the orbital movement of the movable scroll member 11.

During the operation, the rotary ring 13 is urged to be rotated about its own axis. However, an arrangement of the more than three self-rotation blocking pins 15, which are in contact with the inner surfaces of the fixed sleeves 16 in the equiangularly spaced recess **2*b* in the housing 2, can prevent the rotary ring 13** from being rotated about its own axis.

Similarly, the rotary scroll member 11 rotatably supported on the bushing 10 is itself urged to be rotated about the axis of the bushing 10. However, into the inner peripheral surfaces of the sleeves 17 fitted to the rotary scroll member 11, the equiangularly spaced four self-rotation blocking pins 15 are engaged, which are supported by the rotary ring 13 which is itself prevented from being rotated about its own axis. As a result, the rotary scroll member 11 is prevented from being rotated about the axis of the bushing 10.

FIG. 5-A shows the state where the compressor is stopped in its operation. In this stopped condition of the compressor, the force of the spring 20 for controlling the radius of the orbital movement causes the bushing 10 to be moved to the limiting position $Pr_0$. When the bushing 10 is located at the position $Pr_0$, the center axis of the bushing 10 is located on a position $C_{11}$ which is spaced from the axis $C_0$ of the rotating shaft 6 by a distance $r_0$, so that the radius of the orbital movement of the bushing, i.e., the radius of the orbital movement of the movable scroll member is equal to $r_0$. This radius $r_0$ of the orbital movement is smaller than the radius r of the orbital movement which is obtained when the scroll wall portions **1*b* and 11*b* are in side-by-side contact as shown in FIG. 4. Namely, FIG. 6 shows a positional relationship between the scroll walls 1*b* and 11*b* when the radius of the orbital movement of the movable scroll member 11 is equal to $r_0$. In this condition the radius of the orbital movement of the movable scroll member 11 is equal to $r_0$, no contact is obtained between the peripheral surfaces of the scroll walls portions 1*b* and 11*b* is obtained, and this allows the adjacent closed chambers S to be in communication via gaps Q between the portions of the walls 1*b* and 11*b*. The value of the gap Q is substantially equal to the displaceable distance of the bushing 10**.

When the drive shaft 6 commences its rotation, a rotating driving force is transmitted to the bushing 10 via the drive force transmission plane $6a_1$ of the drive projection 6 and the drive force receiving plane $10a_1$ of the bushing 10, so that an orbital movement of the movable scroll member 11 is obtained. The commencement of the orbital movement of the movable scroll member 11 causes the refrigerating gas in the closed chambers S to be compressed. The compression of the gas causes a compression reaction force to be generated in the movable scroll member 11, thereby generating a compression reaction force F as shown by an arrow at the position of the center $C_{11}$ of the bushing 10 in FIG. 1. This compression reaction force F is received at the driving force transmutation plane $6a_1$ of the drive projection **6*a*, so that a component force f (=F×sin θ) as shown by an arrow is applied to the bushing 10 in a direction that the bushing 10** is moved from the limiting position $Pr_0$ as shown by a solid line towards the limiting position Pr as shown by a dotted line.

It is desirable that the weight 9 is of such dimensions that the centrifugal force of the movable scroll member 11 can be completely balanced. However, a limitation to a permissible size of the compressor makes it difficult that the balance weight can fully balance the centrifugal force of the movable scroll member 11. Namely, the centrifugal force of the balancing weight 9 is smaller than the centrifugal force of the movable scroll member 11. As a result, an increase in the rotational speed of the shaft after the switching on causes the surplus centrifugal force of the movable scroll member to be increased. A combined force of the surplus centrifugal force due to the increase in the rotational speed after the switching on and of the component force f of the compression reaction force can overcome the set force of the orbital movement radius adjusting spring 20, so that the bushing 10 is moved toward the limiting position Pr.

In the condition where the bushing 10 is moved to the limiting position Pr, a radius of the orbital movement of the scroll member is equal to r. In other words, the movable scroll member attains an orbital movement of the radius r which is larger than the radius $r_0$ obtained during the stopped condition, so that the side of the scroll wall member **11*b* is contacted with the side of the scroll member 1*b* with a force which is the combined force of the centrifugal force and the component force f minus the spring force of the orbital movement radius adjusting spring 20. As a result, a desired contact condition is obtained between the side surfaces of the scroll walls 1*b* and 11*b* as shown in FIG. 4**, thereby obtaining a tightly closed condition of the chamber S.

FIG. 7 is a graph showing a relationship between the rotational speed and the residual centrifugal force, as a characteristic of the spring 20 for adjusting the radius of the orbital movement. On the abscissa, α and β are values of the rotational speed in the usual range of the rotational speeds. On the ordinate, K is the spring force of the spring. Namely, in accordance with the increase in the rotational speed, the residual centrifugal force of the movable scroll member 11 is increased, thereby increasing the force of the scroll wall portion **11*b* contacting with the scroll wall portion 1*b*. An ideal setting of the spring force of the spring 20 is such that, within the normal range of rotational speeds from α to β, the spring force for canceling the residual centrifugal force is generated so as to maintain the force for making the scroll wall portion 11*b* contact the scroll wall portion 1*b*. Such a setting of the spring force of the spring 20 prevents the scroll wall portion 11*b* from being instantly contacted with the scroll wall portion 1*b* irrespective of the residual centrifugal force of the movable scroll member 11. In other words, for a short period after the switching on the compressor, a communication via the gaps Q in FIG. 6 is maintained between the closed spaces S which are adjacent with each other, which prevents the compression reaction force from rapidly increasing. As a result, a rapid increase in the load of the compressor as well as vibration and a shock can be suppressed. Furthermore, in a situation that a liquid compression fluid is in the compressor, the liquid-state refrigerant can leak through the gaps Q between the scroll wall portions 1*b* and 11*b***, thereby preventing the occurrence of problems due to an abnormal increase in the pressure, such as noise, damage to the scroll members, damage to the delivery valve or slippage in the clutch.

It should be noted that the above problem of the rapid increase in the load, such as a vibration and shock are generated only during a short period of 1 to 2 seconds after the switching on of the compressor. According to the present invention, these problems can be solved, due to the fact that the radius of the orbital movement is grows gradually from a small value due to the provision of the resilient force of the spring 20, when the compressor is started.

The present invention is not limited to the above embodiment. Namely, as shown in FIG. 8, a bushing 10A and a balancing weight 9A are made as separate pieces. A spring 20 for adjusting a radius of the orbital movement is arranged between the weight 9A and the drive projection 6*a*. The bushing 10A and the balancing weight 9A, as separate pieces, are connected with each other by means of any suitable means, so that the bushing 10A can be radially moved in accordance with the centrifugal force against the force of the spring for varying a value of the radius of the orbital movement, similar to the first embodiment of the present invention. In this embodiment, an arrangement is possible where the spring 20 is arranged between the bushing 10A and the drive projection 6*a*.

FIGS. 9 and 10 show a third embodiment, wherein the rotating shaft 6 is formed with a groove 6*c*, which functions for transmitting a drive force from the shaft 6, while the bushing 10 is provided with a projection 10*b*, which functions for receiving the force, and which is inserted to the driving force transmitting groove 6*c*. As shown in FIG. 10, the drive force transmission groove 6*c* forms a drive force transmitting plane $6c_1$, which extends along the rotating axis, on one hand, and extends substantially radially, on the other hand. The driving force receiving projection 10*b* forms a driving force receiving plane $10b_1$, which extends along the rotating axis, on one hand, and extends substantially radially, on the other hand. The driving force receiving plane $10b_1$ allows the bushing to be slidably guided on the driving force transmitting plane $6c_1$. Similar to the first embodiment, in a plane transverse to the axis of the ration of the shaft, the driving force transmission plane $6c_1$ is inclined with respect to the line L connecting the center $C_1$ of the bushing 10 and the center $C_0$ of the rotating shaft 6, at an angle α, in a direction opposite to the direction of the rotation of the shaft 6 as shown by an arrow R and as explained in FIG. 5-A with reference to the first embodiment. A spring 20 for adjusting the radius of the orbital movement is arranged between the driving force transmission groove 6*c* and the driven projection 10*b*. As a result, similar to the first embodiment, when the compressor is brought into an operation a gradual change in the radius of the orbital movement occurs from a condition where the radius is of a small value to a condition where the radius is of a large (normal) value. As a result, as in the first embodiment, drawbacks such as a rapid increase in the load as well as a compression of a liquid refrigerant are prevented.

FIG. 11 shows a modification of the first embodiment. In place of the spring 20, a resilient member 21 made of resilient material such as a rubber is arranged between the drive projection 6*a* extending integrally from the end of the drive shaft 6 and the radial inner surface of the groove 10*a* of the bushing 10. When the compressor is at rest, the resilient member 21 urges the bushing to assume a position where a small value of the radius of the orbital movement is obtained. When the compressor commences its operation, the centrifugal force causes the bushing 10 to be gradually moved against the force of the resilient member to a normal position where a usual value of the radius of the orbital movement is obtained.

In the illustrated embodiments, the spring 20, as an urging means, provided for urging the bushing to the state of a small value of the radius of the orbital movement has a linear characteristic. The spring means can also be one that produces a non-linear characteristic. Furthermore, the urging force of the spring may be varied in accordance with the speed of the displacement.

While particular embodiments are explained with reference to the attached drawings, many modifications and changes can be made by those skilled in this art without departing from the scope and sprint of the present invention.

We claim:

1. A scroll compressor comprising:

a housing;

a drive shaft having an axis and being rotatably supported by said housing;

a first scroll member arranged in and fixed to said housing;

a movable second scroll member having an axis and disposed within said housing, wherein said first and second scroll members each have opposing scroll portions which together define radially spaced chambers;

a bushing having an axis and having said second scroll member arranged thereon, said bushing being arranged eccentrically relative to said drive shaft, wherein said drive shaft is connected to said bushing such that said bushing having said second scroll member arranged thereon is movable in an orbit about said axis of said drive shaft, wherein one of an axial end of said shaft and said bushing is provided with a tab projection extending axially therefrom and the other of said axial end of said shaft and said bushing is provided with an axially extending slot into which said tab projection is received, wherein a width dimension of said slot is greater than a width dimension of said tab projection, thereby permitting relative movement between said drive shaft and said bushing along the width dimension of said slot, said width dimensions of said tab projection and said slot lying on an imaginary line which intersects an imaginary line connecting said axis of said drive shaft and said axis of said bushing and which is canted relative thereto in a direction opposite from an operative direction of rotation of said drive shaft;

means for preventing rotation of said second scroll member while allowing said second scroll member to move orbitally about said axis of said drive shaft, thereby causing said radially spaced chambers to move radially inward while concurrently compressively decreasing a volume of each radially spaced chamber;

an inlet through which a medium is introduced into said radially spaced chambers;

an outlet through which the medium is discharged in a compressed state corresponding to said decreasing volume of said radially spaced chambers;

means, responsive to a centrifugal force, for varying the eccentricity of said bushing relative to said drive shaft; and biasing means for urging said bushing towards a minimum eccentricity relative to said drive shaft, wherein said bushing is movable towards a maximum eccentricity relative to said drive shaft according to a reaction force corresponding to a compression force exerted by said radially spaced chambers having decreasing respective volumes.

2. A scroll compressor according to claim 1, wherein said biasing means comprises an expansible coil spring for urging said bushing towards said minimum eccentricity relative to said drive shaft.

3. A scroll compressor according to claim 1, wherein said biasing means comprises a block of resilient material for generating a resilient force for urging said bushing towards said minimum eccentricity relative to said drive shaft.

4. A scroll compressor according to claim 1, wherein said tab projection is provided on said drive shaft and said slot is formed in said bushing.

5. A scroll compressor according to claim 1, wherein said tab projection is provided on said bushing and said slot is formed in said drive shaft.

6. A scroll compressor according to claim 1, wherein said biasing means is arranged between said tab projection and said bushing.

7. A scroll compressor comprising:

a housing;

a drive shaft having an axis and being rotatably supported by said housing;

a first scroll member arranged in and fixed to said housing;

a second scroll member having an axis and being movably disposed in said housing said first and second scroll members having opposing scroll portions which together define radially spaced chambers;

a bushing having an axis and said second scroll member arranged thereon arranged eccentric to said drive shaft, wherein said drive shaft includes a drive projection which extends axially from one end of said drive shaft at a location spaced from said axis of said drive shaft, wherein said bushing includes a groove into which said drive projection is received, said drive projection having a driving surface lying in a plane parallel to said axis of said drive shaft, said groove having a driven surface lying in a plane which is inclined relative to a line connecting said axis of said drive shaft and said axis of said bushing in an inclination direction opposite to an operative direction of rotation of said drive shaft;

means for preventing said second scroll member from rotating while allowing said second scroll member to move orbitally about said said axis of said drive shaft, thereby causing said radially spaced chambers defined by said first and second scroll members to move radially inwardly while a volume of each radially spaced chamber progressively decreases;

an inlet through which a medium is introduced into said radially spaced chambers an outlet through which the medium is discharged in a compressed state corresponding to said decreasing volume of said radially spaced chambers; and biasing means, arranged between said projection and said bushing in said groove, for urging said bushing toward a minimum eccentricity relative to said drive shaft, wherein a reaction force corresponding to compression of the medium in the radially spaced chambers acts to urge said bushing towards a maximum eccentricity relative to said drive shaft against said biasing means.

8. A scroll compressor comprising:

a housing;

a drive shaft having an axis and being rotatably supported by said housing;

a first scroll member arranged in and fixed to said housing;

a movable second scroll member having an axis, said first and second scroll members each having opposing scroll portions which together define radially spaced chambers;

a bushing having an axis and eccentrically disposed relative to said drive shaft and having said second scroll member arranged thereon, wherein said drive shaft is provided with an axially extending groove formed in an end thereof, said groove being radially offset from said axis of said drive shaft, said bushing having an axially extending projection provided thereon which is received by said groove, wherein said projection can move relative to said groove along a width dimension of said groove, said drive projection having a driving surface lying in a plane parallel to said axis of said drive shaft, said groove having a driven surface lying in a plane which is inclined relative to a line connecting said axis of said drive shaft and said axis of said bushing in an inclination direction opposite to an operative direction of rotation of said drive shaft;

means for preventing said second scroll member arranged on said bushing from rotating while allowing said second scroll member to move orbitally about said drive shaft, thereby causing said radially spaced chambers to move radially inwardly while decreasing a volume of each radially spaced chamber;

an inlet through which a medium is introduced into said radially spaced chambers;

an outlet through which the medium, compressed by said decreasing volume of the radially spaced chambers, is discharged; and biasing means, arranged between an interior of said groove and said projection, for urging said bushing toward a minimum eccentricity relative to said drive shaft, wherein a reaction force corresponding to compression of the medium in the radially spaced chambers acts to urge said bushing towards a maximum eccentricity relative to said drive shaft, against said biasing means.

* * * * *